US005529352A

United States Patent [19]

Chin

[11] Patent Number: 5,529,352

[45] Date of Patent: Jun. 25, 1996

[54] EARTHQUAKE RESPONSIVE LATCH

[76] Inventor: Humphrey M. Chin, 3770 Cardinal Ter., Fremont, Calif. 94555

[21] Appl. No.: 299,947

[22] Filed: Sep. 2, 1994

[51] Int. Cl.[6] ..... E05C 3/02

[52] U.S. Cl. ..... 292/230; 292/DIG. 22; 292/244

[58] Field of Search ..... 292/230.92, 231, 292/DIG. 22, DIG. 65, DIG. 53, DIG. 60, 244

[56] References Cited

U.S. PATENT DOCUMENTS

| | | | |
|---|---|---|---|
| 1,448,137 | 3/1923 | Lindsay | 292/230 X |
| 1,493,573 | 5/1924 | Steffen | 292/230 X |
| 1,789,619 | 1/1931 | Dodd, Jr. | 292/230 |
| 5,035,451 | 7/1991 | Brady | 292/DIG. 22 X |

FOREIGN PATENT DOCUMENTS

| | | | |
|---|---|---|---|
| 687593 | 2/1953 | United Kingdom | 292/230 |

*Primary Examiner*—Rodney M. Lindsey

[57] ABSTRACT

A latch responsive to inertial movement of a structure for locking a closure during an earthquake. The inventive device includes a base plate mountable to the interior structure of a cabinet or the like. A latch is pivotally mounted at a lower end thereof to the base plate and projects upward to rest against a guide pin. A hook is mounted to the interior of the cabinet door such that movement of the cabinet during an earthquake will cause the latch to fall into engagement with the hook to lock the cabinet door shut.

5 Claims, 3 Drawing Sheets

EARTHQUAKE RESPONSIVE LATCH

BACKGROUND OF THE INVENTION

1. Field of the Invention

The present invention relates to latch structures and more particularly pertains to an earthquake responsive latch for locking a closure during an earthquake.

2. Description of the Prior Art

The use of latch structures is known in the prior art. More specifically, latch structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art latch structures include U.S. Pat. Nos. 5,152,562; 4,626,007; 4,893,855; and 3,936,086.

While these devices fulfill their respective, particular objectives and requirements, the aforementioned patents do not disclose an earthquake responsive latch for locking a closure during an earthquake which includes a base plate mountable to the interior structure of a cabinet, a latch pivotally mounted at a lower end thereof to the base plate and projecting upwardly therefrom to rest against a guide pin, and a hook mounted to the interior of the cabinet door such that movement of the cabinet during an earthquake will cause the latch to fall into engagement with the hook to lock the cabinet door shut.

In these respects, the earthquake responsive latch according to the present invention substantially departs from the conventional concepts and designs of the prior art, and in so doing provides an apparatus primarily developed for the purpose of responding to inertial movement of a structure to lock a closure during an earthquake.

SUMMARY OF THE INVENTION

In view of the foregoing disadvantages inherent in the known types of latch structures now present in the prior art, the present invention provides a new earthquake responsive latch construction wherein the same can be utilized for flocking a closure during an earthquake. As such, the general purpose of the present invention, which will be described subsequently in greater detail, is to provide a new earthquake responsive latch apparatus and method which has many of the advantages of the latch structures mentioned heretofore and many novel features that result in an earthquake responsive latch which is not anticipated, rendered obvious, suggested, or even implied by any of the prior art latch structures, either alone or in any combination thereof.

To attain this, the present invention generally comprises a latch responsive to inertial movement of a structure for locking a closure during an earthquake. The inventive device includes a base plate mountable to the interior structure of a cabinet or the like. A latch is pivotally mounted at a lower end thereof to the base plate and projects upward to rest against a guide pin. A hook is mounted to the interior of the cabinet door such that movement of the cabinet during an earthquake will cause the latch to fall into engagement with the hook to lock the cabinet door shut.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new earthquake responsive latch apparatus and method which has many of the advantages of the latch structures mentioned heretofore and many novel features that result in an earthquake responsive latch which is not anticipated, rendered obvious, suggested, or even implied by any of the prior art latch structures, either alone or in any combination thereof.

It is another object of the present invention to provide a new earthquake responsive latch which may be easily and efficiently manufactured and marketed.

It is a further object of the present invention to provide a new earthquake responsive latch which is of a durable and reliable construction.

An even further object of the present invention is to provide a new earthquake responsive latch which is susceptible of a low cost of manufacture with regard to both materials and labor, and which accordingly is then susceptible of low prices of sale to the consuming public, thereby making such earthquake responsive latches economically available to the buying public.

Still yet another object of the present invention is to provide a new earthquake responsive latch which provides in the apparatuses and methods of the prior art some of the advantages thereof, while simultaneously overcoming some of the disadvantages normally associated therewith.

Still another object of the present invention is to provide a new earthquake responsive latch for locking a closure during an earthquake.

Yet another object of the present invention is to provide a new earthquake responsive latch which includes a base plate mountable to the interior structure of a cabinet, a latch pivotally mounted at a lower end thereof to the base plate and projecting upwardly therefrom to rest against a guide pin, and a hook mounted to the interior of the cabinet door such that movement of the cabinet during an earthquake will cause the latch to fall into engagement with the hook to lock the cabinet door shut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
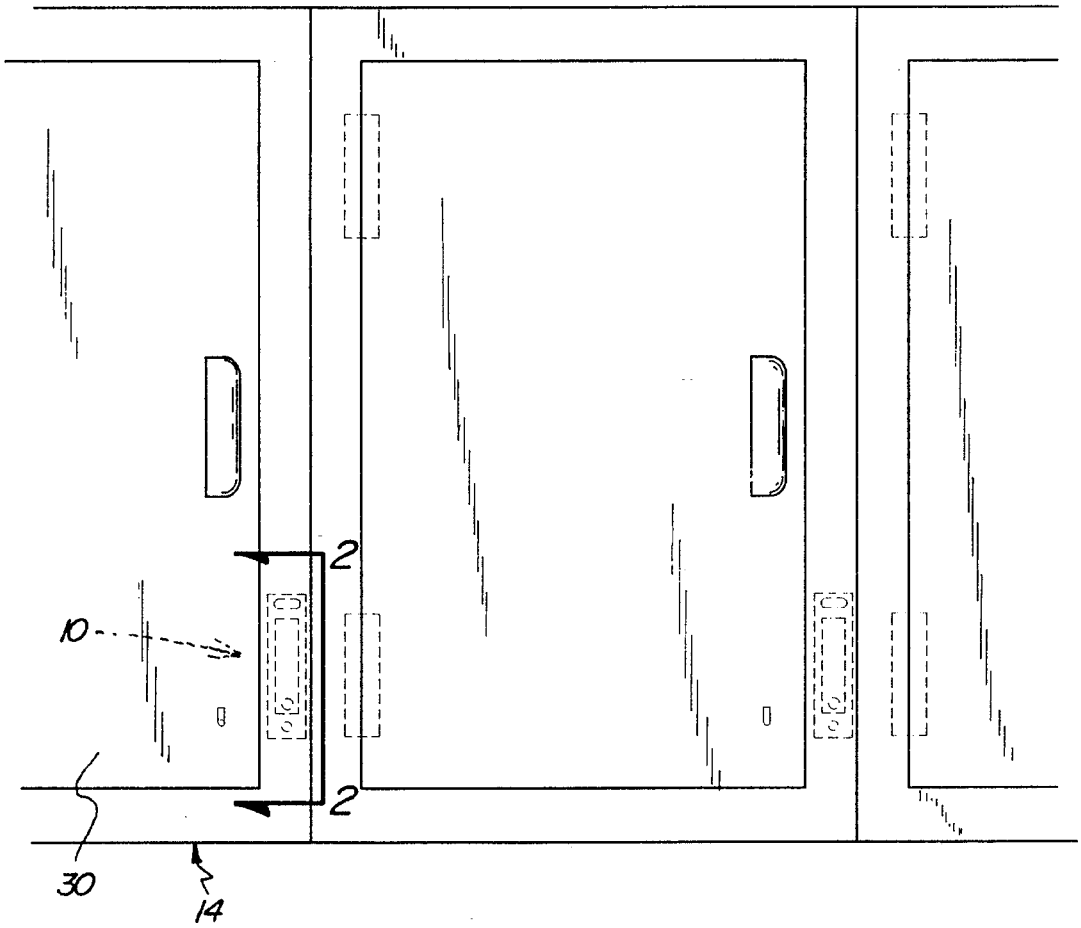
FIG. 1 is a front elevation view of a cabinet structure including an earthquake responsive latch according to the present invention.

With reference now to the drawings, and in particular to FIGS. 1–6 thereof, a new earthquake responsive latch embodying the principles and concepts of the present invention and generally designated by the reference numeral 10 will be described.

Figure 2:
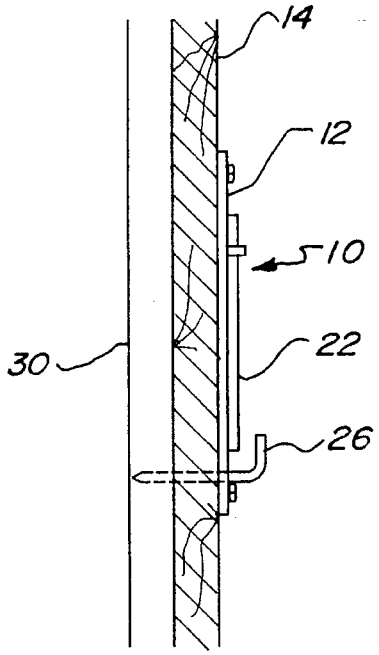
FIG. 2 is a cross-sectional view taken along line 2—2 of FIG. 1.
Figure 3:
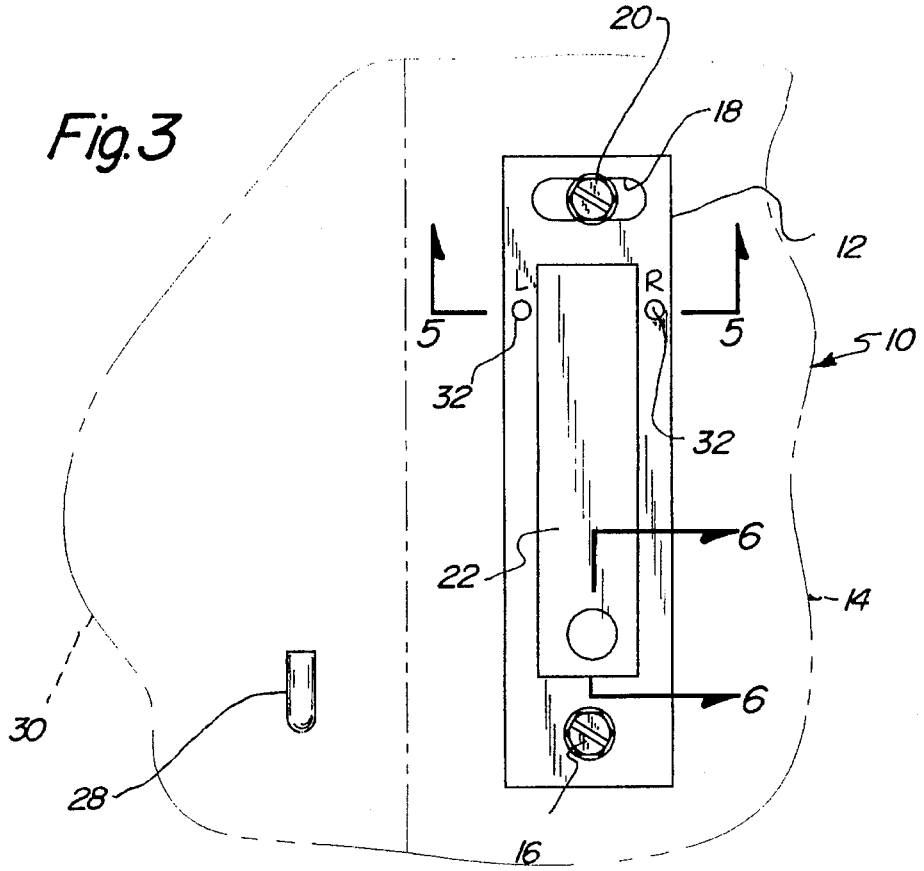
FIG. 3 is a front elevation view of the invention as installed along an interior portion of the cabinet structure.
Figure 4:
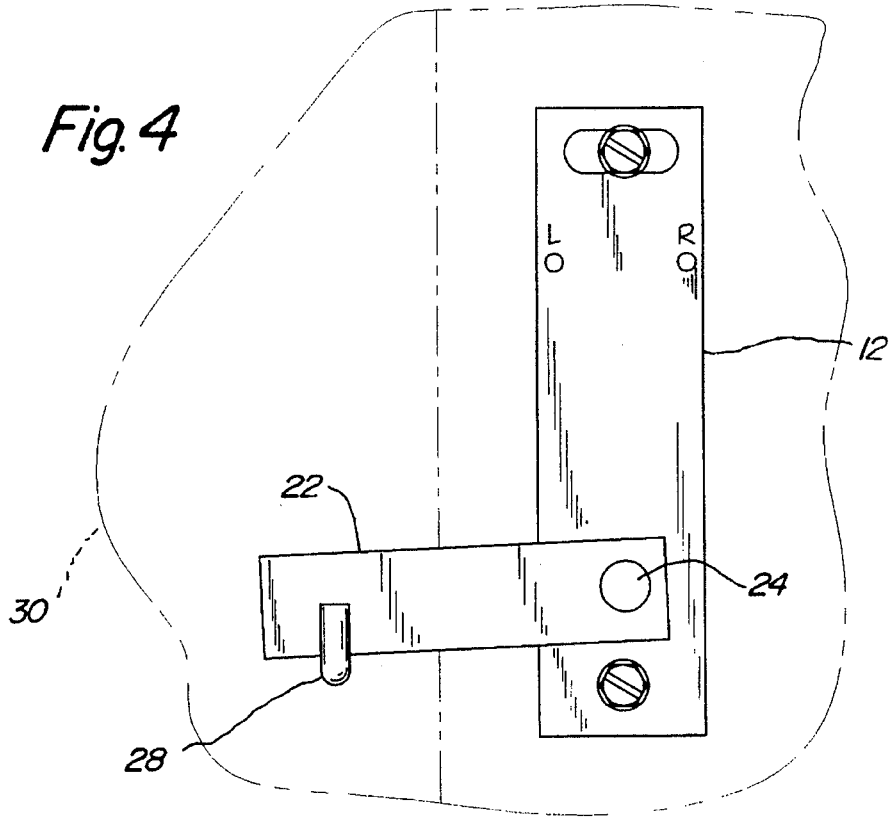
FIG. 4 is a front elevation view of the invention in a latched position.
Figure 5:
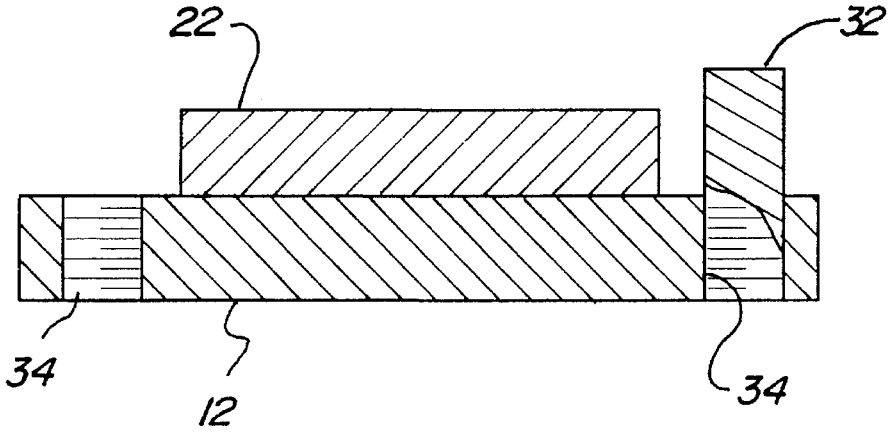
FIG. 5 is a cross-sectional view taken along line 5—5 of FIG. 3.

More specifically, it will be noted that the earthquake responsive latch 10 comprises a substantially planer base plate 12 for mounting along an interior portion of a cabinet structure 14, as best illustrated in FIGS. 1 and 2. The base plate 12, as shown in FIGS. 3 and 4, is preferably substantially rectangularly shaped and includes an unlabelled through-extending mounting aperture at a lower end thereof through which a mounting fastener 16 projects to engage the interior surface of the cabinet structure 14. Preferably, the mounting fastener 16 is a threaded fastener which may be selectively tightened during installation and adjustment of the device 10. The base plate 12 further includes an adjustment aperture 18 extending through an upper proximal end of the base plate which permits an adjustment fastener 20 to be directed through the base plate and engaged to the cabinet structure 14. The adjustment aperture 18 comprises a substantially elongated aperture which permits rotative adjustment of the base plate 12 about the mounting fastener 16 and relative to the cabinet structure 14 to permit levelling of the base plate 12 into a substantially orthogonal orientation relative to the horizontal axis. The adjustment fastener 20, similar to the mounting fastener 16, is preferably a threaded fastener which permits tightening thereof during installation and adjustment of the device 10.

Figure 6:
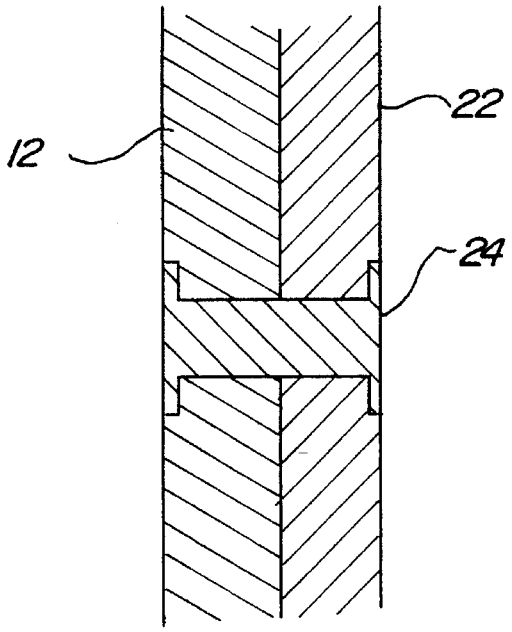
FIG. 6 is a further cross-sectional taken along line 6—6 of FIG. 3.

As best illustrated in FIG. 4, a latch member 22 is pivotally mounted at a lower end of the latch member to the base plate 12 by a pivot pin 24 which extends through both the latch member and the base plate. FIG. 6 illustrates that the pivot pin 24 preferably comprises a rivet extending through both the latch member 22 and the base plate 12. By this structure, the latch member 22 is permitted to rotate about the pivot pin 24 relative to the base plate 12 into either of the positions illustrated in FIGS. 3 and 4.

The earthquake responsive latch 10 further includes a hook member 26 which is securable to the interior surface of a cabinet door 30 forming a pivotal closure of the cabinet structure 14. The hook 28 is positioned so as to reside adjacent to the base plate 12 such that the latch 22 may be pivoted into engagement with the hook 28, as illustrated in FIG. 4. By this structure, a positioning of the latch member 22 in the vertical orientation illustrated in FIG. 3 permits opening and closing of the cabinet door 30 in a conventional manner, whereby a movement of the latch 22 into the position illustrated in FIG. 4 will preclude the cabinet door from opening. Preferably, the hook 28 extends from the interior surface of the cabinet door 30 a distance sufficient to permit slight opening of the locked cabinet door relative to the cabinet structure 14 such that a tool or an individual's finger may be inserted between the cabinet door 30 and the cabinet structure 14 to effect pivoting of the latch member 22 away from the hook 28 to unlock the device 1O.

When the latch member 22 is positioned in the vertical orientation illustrated in FIG. 3, is preferable to include at least one guide pin 32 directed into the base plate against which the latch member 22 will rest. To this end, the base plate 12 preferably includes (see FIG. 5) a pair of threaded pin apertures 34 disposed on laterally opposed sides of the base plate 12 proximal to the upper end thereof. The threaded pin apertures 34 are configured to threadably receive the guide pins 32 on either side of the latch member 22. By this structure, one of the guide pins 32 may be selectively removed to permit movement of the latch member 22 in a single desired direction. In other words, for cabinet doors located to the left of the device 10 as illustrated in FIG. 3, the guide pin 32 labelled "L" should be removed to permit pivoting of the latch member 22 into the hook 28 as shown in FIG. 4. In contrast, should the cabinet door 30 be located on the right side of the device 10, the guide pin 32 labelled "R" should be removed to permit pivoting of the latch member 22 in a clockwise direction relative to the illustration of FIG. 3.

In use, the earthquake responsive latch 10 may be easily installed to the interior of a cabinet structure 14 whereby operation of the cabinet doors 30 relative to the cabinet structure is permitted without interference of the latch. During an earthquake, inertial movement of the cabinet structure 14 will cause the latch member 22 to fall away from the associated guide pin 32 and pivot relative to the base plate 12 into engagement with the hook 28. When the latch 22 is engaged to the hook 28, pivoting or opening of the cabinet door 30 is precluded, thereby retaining the contents of the cabinet structure 14 therewithin.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An earthquake responsive latch comprising:

a base plate for mounting along an interior portion of a cabinet structure;

a latch member pivotally mounted at a lower end thereof to said base plate;

guide pin means for supporting said latch member in a substantially vertical orientation;

a hook member securable to an interior surface of a cabinet door such that said latch member is pivotally engagable with said hook member to lock said cabinet door relative to said cabinet structure;

wherein said base plate includes a pair of threaded pin apertures disposed on laterally opposed sides and proximal to an upper end thereof, and further wherein said guide pin means comprises at least one guide pin threadably received within an individual one of said threaded pin apertures so as to permit pivoting movement of said latch member relative to said base plate in a single desired direction.

2. The earthquake responsive latch of claim 1, wherein said base plate is substantially rectangularly shaped and includes a through-extending mounting aperture at a lower end thereof through which a mounting fastener projects to engage said interior portion of said cabinet structure, said base plate further including an adjustment aperture extending through an upper proximal end of said base plate for permitting an adjustment fastener to be directed through said base plate and engaged to said cabinet structure, said adjustment aperture comprising a substantially elongated aperture which permits rotative adjustment of said base plate about said mounting fastener aperture and relative to said cabinet structure to permit levelling of said base plate into a substantially orthogonal orientation relative to the horizontal.

3. The earthquake responsive latch of claim 2, and further comprising a pivot pin, wherein said latch member is pivotally mounted to said base plate by said pivot pin extending through both said latch member and said base plate.

4. The earthquake responsive latch of claim 3, wherein said pivot pin comprises a rivet extending through both said latch member and said base plate.

5. An earthquake responsive latch comprising:

a base plate for mounting along an interior portion of a cabinet structure, said base plate being substantially rectangularly shaped and including a through-extending mounting aperture at a lower end thereof through which a mounting fastener projects to engage said interior portion of said cabinet structure, said base plate further including an adjustment aperture extending through an upper proximal end of said base plate for permitting an adjustment fastener to be directed through said base plate and engaged to said cabinet structure, said adjustment aperture comprising a substantially elongated aperture which permits rotative adjustment of said base plate about said mounting fastener aperture and relative to said cabinet structure to permit levelling of said base plate into a substantially orthogonal orientation relative to the horizontal, said base plate further including a pair of threaded pin apertures disposed on laterally opposed sides and proximal to an upper end thereof;

a latch member pivotally mounted at a lower end thereof to said base plate;

a pivot pin, wherein said latch member is pivotally mounted to said base plate by said pivot pin extending through both said latch member and said base plate, said pivot pin comprising a rivet extending through both said latch member and said base plate;

guide pin means for supporting said latch member in a substantially vertical orientation, said guide pin means comprising at least one guide pin threadably received within an individual one of said threaded pin apertures so as to permit pivoting movement of said latch member relative to said base plate in a single desired direction;

and, a hook member securable to an interior surface of a cabinet door such that said latch member is pivotally engagable with said hook to lock said cabinet door relative to said cabinet structure, said hook being of a length such that when installed to said cabinet door and engaged to said latch member said hook extends from said interior surface of said cabinet door a distance sufficient to permit slight opening of said cabinet door relative to the cabinet structure such that a tool can be inserted between said cabinet door and said cabinet structure to effect pivoting of the latch member away from said hook.

* * * * *

UNITED STATES PATENT AND TRADEMARK OFFICE

CERTIFICATE OF CORRECTION

PATENT NO. : 5,529,352
DATED : June 25, 1996
INVENTOR(S) : Humphrey M. Chin

It is certified that error appears in the above-indentified patent and that said Letters Patent is hereby corrected as shown below:

Column 1, line 44, "flocking" should be "locking"

Signed and Sealed this

Thirty-first Day of December, 1996

*Attest:*

BRUCE LEHMAN

*Attesting Officer*

*Commissioner of Patents and Trademarks*